US006196494B1

(12) United States Patent
Rollins et al.

(10) Patent No.: US 6,196,494 B1
(45) Date of Patent: Mar. 6, 2001

(54) EXPANDING SHAFT

(75) Inventors: James W. Rollins, Winsted; John McKechnie, Wallingford, both of CT (US)

(73) Assignee: Goldenrod Corporation, Prospect, CT (US)

( * ) Notice: Subject to any disclaimer, the term of this patent is extended or adjusted under 35 U.S.C. 154(b) by 0 days.

(21) Appl. No.: 09/401,531

(22) Filed: Sep. 22, 1999

Related U.S. Application Data

(63) Continuation-in-part of application No. 09/233,167, filed on Jan. 19, 1999, now abandoned.
(60) Provisional application No. 60/103,547, filed on Oct. 8, 1998.

(51) Int. Cl.[7] ..... B65H 75/24
(52) U.S. Cl. ..... 242/571.2; 242/530.3
(58) Field of Search ..... 242/571.2, 571.1, 242/573, 573.2, 573.7, 573.9, 575.2, 575.3, 530.1, 530.3, 530.4; 279/2.06, 2.07, 2.08, 2.09, 2.13, 2.14, 2.15; 269/48.1, 48.2, 48.3, 48.4

(56) References Cited

U.S. PATENT DOCUMENTS 3,592,405 * 7/1971 Young ..... 242/571.2
4,026,491 * 5/1977 Bostroem .
4,332,356 * 6/1982 Damour .
4,771,963 * 9/1988 Gattrugeri ..... 242/571.2
5,597,134 * 1/1997 Marin ..... 242/571.2
5,746,386 * 5/1998 Marin ..... 242/571.2

FOREIGN PATENT DOCUMENTS

2669013 * 5/1992 (FR) .

* cited by examiner

*Primary Examiner*—John M. Jillions
(74) *Attorney, Agent, or Firm*—Dykema Gossett PLLC

(57) ABSTRACT

A cylindrical shaft has a plurality of radially disposed slots extending longitudinally thereof and opening at the outer surface of the shaft. A radially movable mechanism is disposed within each of the slots. Each mechanism is moved outwardly by an expandable tube. One of the slots opens at a side face of the shaft to provide a side opening through which a track can be inserted into and removed from the slot. Springs bias the track radially inwardly. The track includes an open end through which a support can be inserted into and removed from the track. A two piece retainer retains the track and support in operative position. A plurality of core stops are carried by the support and can be either adjustable longitudinally of the support or fixed to the support. The core stops engage side edges of tubular supports disposed around the shaft for spacing the tubular supports for a winding operation. One support with a particular spacing of core stops can be replaced by another support with a different spacing of core stops very quickly to minimize downtime of the shaft. In a modification, the support is of less length than the associated slot, and an adjusting lug is movably supported at opposite ends of the support. Screws are provided for locking the adjusting lugs and the support in adjusted position.

25 Claims, 4 Drawing Sheets

24
20
16
112
110
114
54
56
74
64
40
32
12
4
140
142
122
30
14
18
52
150
22
10
40'
32'
34
60
30'
34'
36'
42'
36
42
120
124
128
134
136
132
130
126

EXPANDING SHAFT

CROSS-REFERENCE TO RELATED APPLICATIONS

The present application is a continuation-in-part of U.S. patent application Ser. No. 09/233,167, filed Jan. 19, 1999, now abandoned, which claims the benefit of the filing date of U.S. provisional application Ser. No. 60/103,547, filed Oct. 8, 1998, the disclosure of which is incorporated herein by reference.

BACKGROUND OF THE INVENTION

The present invention relates to an expanding shaft, and more particularly to an expanding shaft of the type which carries tubular supports on which strips of plastic, aluminum or paper films are wound or from which the strips are unwound.

More specifically, the invention represents an improvement over the construction as shown, for example, in U.S. Pat. Nos. 5,597,134 and 5,746,386, the disclosures of which are incorporated herein by reference.

Expanding shafts are typically used when slitting a wide web of material into discrete widths and rewinding it on cores which may be made of cardboard, plastic or metal and the like. The shaft carries core stops adapted to engage the side edges of the cores to properly space the cores in the correct position for rewinding. The two patents mentioned above provide mobile means mounted for radial movement within slots in the expanding shaft. Core stops are adjustably mounted for axial movement longitudinally of at least one of the mobile means to vary the spacing of the core stops longitudinally of the shaft as desired. Locking means is provided for locking the core stops in position axially of the mobile means and the shaft.

With the arrangement as shown in the two patents, the longitudinal position of the core stops relative to the shaft can be adjusted while the shaft is mounted on a slitter-rewinder machine. However, it takes a significant amount of labor and down time of the machine while such changes are made.

Therefore, there has been a need to provide a construction wherein the slit widths on a slitter-rewinder machine can be changed in a minimum amount of time. Rather than adjusting the core stops to a new width on the machine, operators have replaced the old mobile means and the core stops mounted thereon with a new mobile means which has a predetermined new spacing of the core stops thereon. The old mobile means may be replaced by a new mobile means in a minimum amount of time. The spacing on the new mobile means can be set by a machine operator while the old mobile means is in operation so that when the old mobile means is replaced by the new mobile means, down time of the machine is minimized.

Each mobile means is normally biased by springs radially inwardly of the shaft so that each mobile means is retracted into the shaft when the associated thrusting means is deactivated. The springs act between the shaft and the mobile means. When the mobile means and the core stops carried thereon are removed from the shaft, the springs are difficult to handle and are often lost. It therefore is a principal object of the invention to provide an arrangement whereby at least a portion of a mobile means on which core stops are mounted may be removed and replaced while the retracting springs remain in place within the shaft and are not subjected to any longitudinal forces during such removal and replacement.

A further problem arises in the prior art. When there is a slight change in web position, it is desirable to provide means for axially adjusting the support means and the core stops supported thereby while the support means is mounted in operative position within a slot in the expanding shaft. This has not been possible with prior art constructions.

SUMMARY OF THE INVENTION

The present invention employs a unique construction wherein the mobile means which supports the core stops comprises a track means and a support means. The track means is disposed within the usual slot in the expanding shaft, and the retracting springs act between the shaft and the track means to bias the track means radially inwardly. The track means is slidable into and out of the associated slot in the shaft, but normally remains in place within the slot when the support means carrying the core stops is replaced.

The support means is slidably disposed within the track means and can be readily inserted into or removed from the track means. Retainer means is provided for retaining the track means and the support means in position longitudinally of the shaft.

The retainer means includes a first retainer portion which retains the track means in position, and a screw is provided for fixing this first retainer portion in position longitudinally of the shaft. The retainer means includes a second retainer portion which retains the support means in position, and a screw is provided for fixing the second retainer portion in position longitudinally of the first retainer portion. The first retainer portion also serves to clamp an open end portion of the thrusting means together to provide an air tight seal thereat so that the thrusting means can be inflated with air when desired.

With the present invention, the second portion of the retainer means can be quickly removed, whereupon the support means carrying the core stops can be slid out of the track means and replaced by a new support means having different spacing between the core stops thereof. The second retainer portion can then be replaced to hold the new support means in position on the shaft. This can be rapidly accomplished.

If certain slit widths are regularly used, the core stops can remain in the same longitudinal position and dedicated support means having the core stops adjusted to the required spacing may be repeatedly used with the machine as required. A number of dedicated support means may be kept on hand so that it is not necessary to change the positions of the core stops in subsequent operations. The core stops can be readily manually adjusted in the illustrated embodiment to provide maximum flexibility of use of the device. However, where a dedicated support means with predetermined spacing is required, the core stops may be fixed to the support means as by welding, thereby eliminating the necessity of providing the construction which permits the core stops to be moved longitudinally with respect to the associated support means and locked in adjusted position.

The invention also includes a modification which provides adjusting means for adjusting the axial position of the support means within an associated slot in the expanding shaft. The length of the support means is less than the length of the associated slot. A pair of adjustment lugs are slidably mounted in opposite ends of the support means and include means for locking the adjustment lugs in position. The adjustment lugs can project axially outwardly of the opposite ends of the support means different distances for adjusting the axial position of the support means while securely holding the support means in adjusted position.

While the adjusting means described in the preceding paragraph is disclosed as being employed in a construction wherein the support means is slidably disposed within a track means, the adjusting means can also be employed in an expanding shaft wherein no track means is utilized and wherein the support means is slidably disposed within one of the slots of the expanding shaft for axial movement relative to the shaft.

DESCRIPTION OF THE PREFERRED EMBODIMENT

Figures 1, 4, 8:
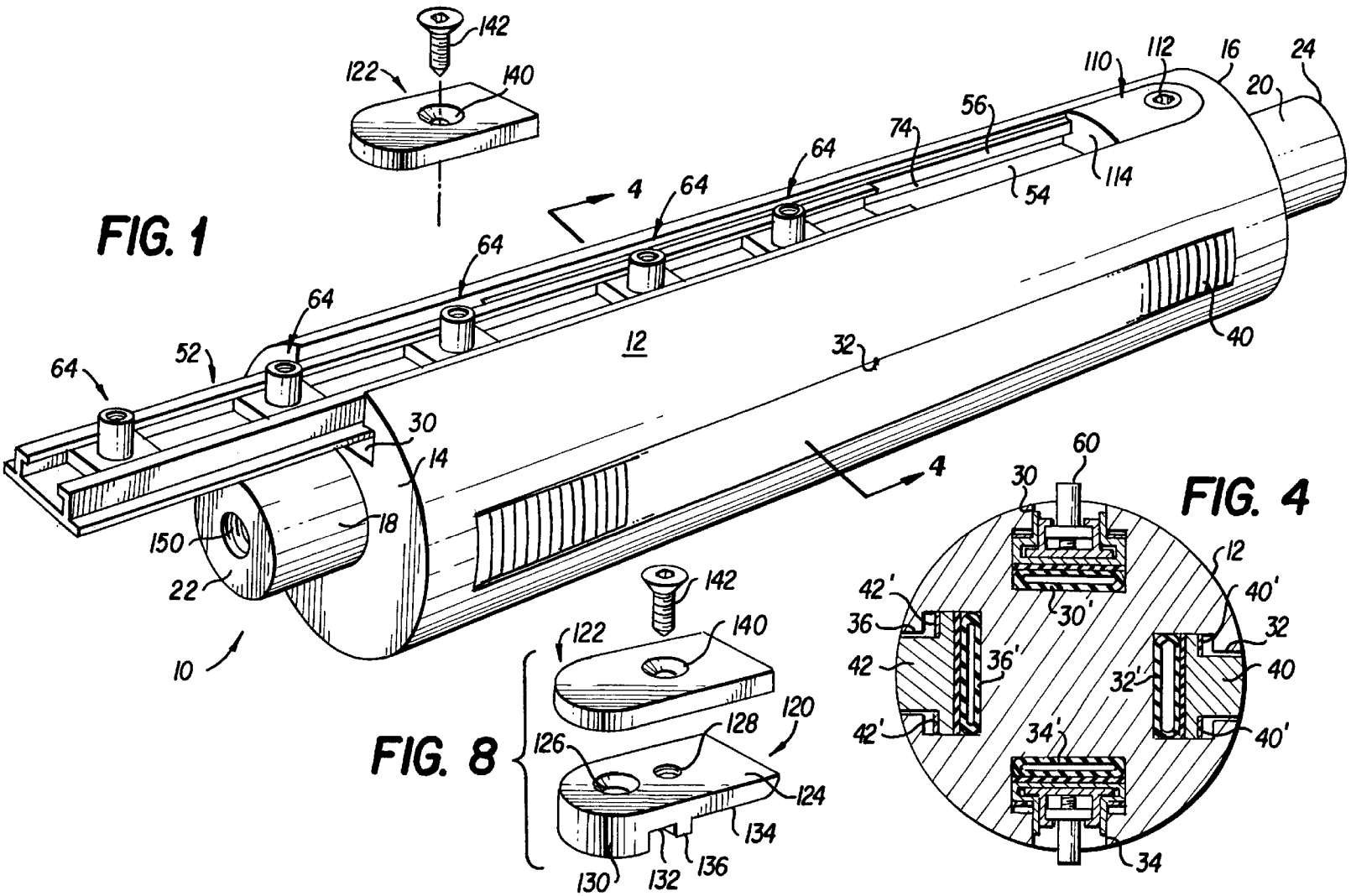
FIG. 1 is a top perspective view of a shaft according to the invention showing certain components partially removed from the shaft and certain other components in an exploded view arrangement.
FIG. 4 is a sectional view taken along line 4—4 of FIG. 1.
FIG. 8 is an exploded view showing the details of construction of the retainer means of the invention.

Referring now to the drawings wherein like reference characters designate corresponding parts throughout the several views, there is shown in FIGS. 1–4 an expanding shaft 10 having a longitudinal axis A—A and a cylindrical outer surface 12. The shaft includes opposite end faces 14 and 16 which are disposed adjacent reduced portions 18 and 20 which terminate in opposite ends 22 and 24 of the shaft respectively. As seen in FIG. 4, four radially disposed and longitudinally extending slots 30, 32, 34 and 36 are provided in shaft 10, each of these slots being of substantially T-shaped cross-sectional configuration and opening at the outer surface of the shaft. Slots 30 and 34 are similar to one another, and slots 32 and 36 are similar to one another. The number and spacing of the slots may be varied, and as shown, slots 32 and 36 open through the outer surface of the shaft short of the opposite end faces thereof as seen in FIG. 1, wherein slot 32 is visible. Slots 30 and 34 open at the side face 14 of the shaft to provide a side opening for a purpose hereinafter discussed. Slot 34 has not been illustrated as opening at side face 14 in FIG. 1 for the sake of clarity.

Referring again to FIG. 4, thrusting means 30', 32', 34' and 36' are disposed in the bottom of slots 30, 32, 34 and 36 respectively, each thrusting means comprising tubes which receive air pressure therein in a well-known manner to expand and force mobile means in the slots radially outwardly of the shaft. The mobile means 40 and 42 each have a generally T-shaped cross-section so that outward movement thereof is limited by the slots within which they are disposed. Conventional spring means 40' and 42' are provided for normally biasing mobile means 40 and 42 respectively in a radially inward direction. The outer surfaces of mobile means 40 and 42 are formed of a suitable friction material so that they are adapted to engage the inner surface of tubular supports disposed around the shaft when the associated thrusting means are activated so that the tubular supports are rotated with the shaft. The construction and operation of mobile means 40 and 42 are well-known.

Figure 2:
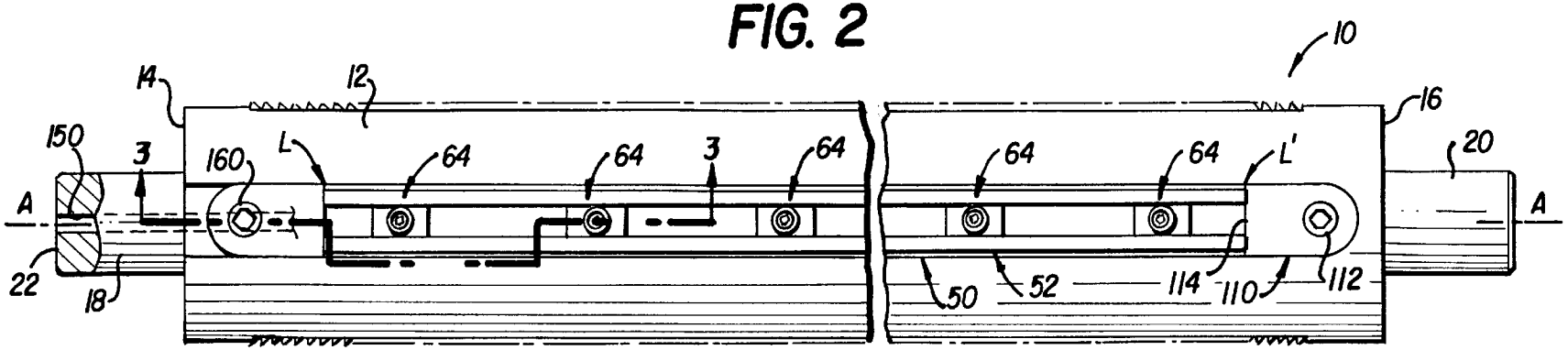
FIG. 2 is a top view of the shaft shown in FIG. 1 with the components in assembled position.
Figure 5:
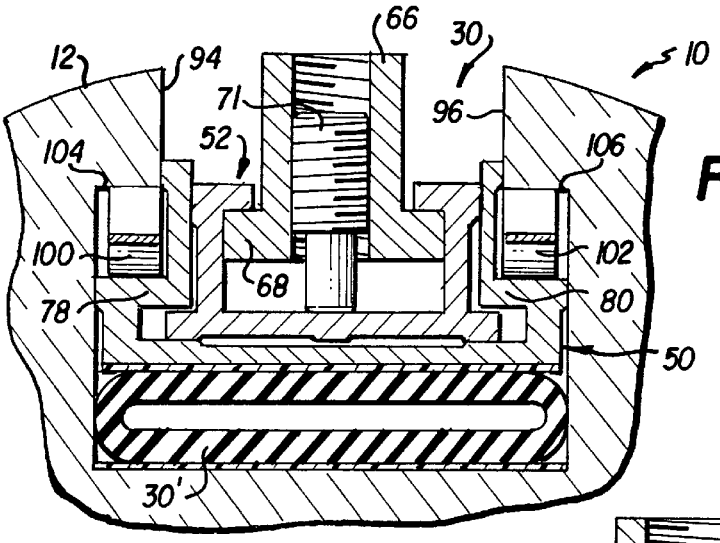
FIG. 5 is an enlarged view of the upper portion of FIG. 4.
Figure 6:
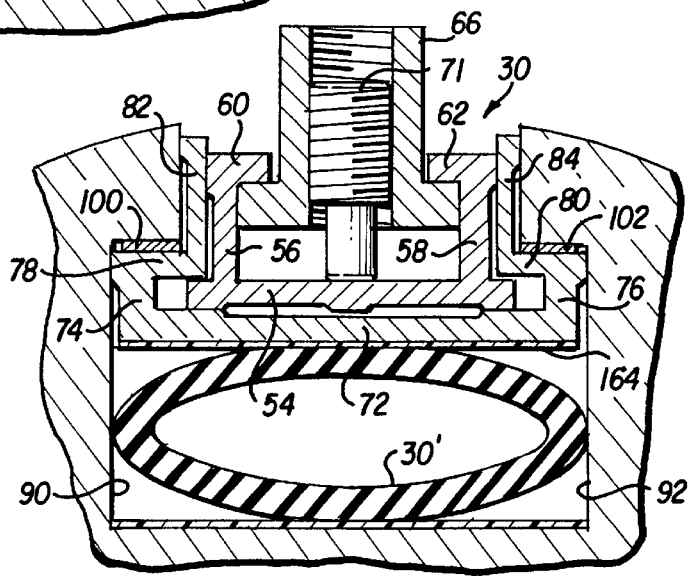
FIG. 6 is a view similar to FIG. 5 showing the components in a different position.

The mobile means disposed within slots 30 and 34 are similar in construction, and description of the upper mobile means as seen in FIG. 4 is equally applicable to the lower opposite mobile means. Referring to FIGS. 5 and 6, the mobile means in slot 30 includes track means 50 and support means 52 which is slidably supported by the track means. FIG. 5 illustrates the mobile means in retracted position, and FIG. 6 shows the mobile means in expanded position. Each of components 50 and 52 has a particular cross-sectional configuration as explained hereinafter, the components being elongated and having a length extending between opposite ends L and L' thereof as seen in FIG. 2.

Figure 7:
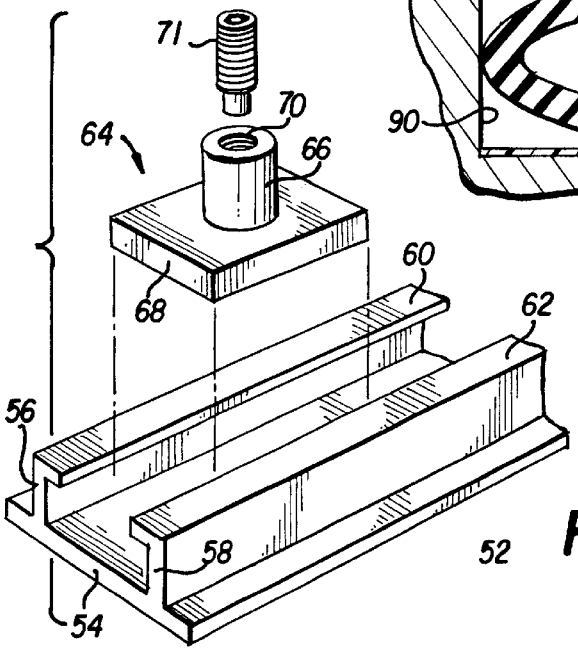
FIG. 7 is an exploded view showing a support means, a core stop and a locking means.

As seen in FIG. 7, support means 52 comprises an extrusion or machined part which may be formed of metal, plastic, fiber or some composite material. Support means 52 defines a bottom wall 54 and a pair of integral upwardly extending side walls 56 and 58 which join with inwardly extending flanges 60 and 62 respectively. The support means supports a plurality of similar core stops 64 each of which includes a cylindrical portion 66 adapted to engage a side edge of a tubular support surrounding the shaft. It is apparent that the portion of the stops 64 may also be elliptical or generally rectangular with rounded corners. Portion 66 joins with a base portion 68 of generally rectangular configuration, a threaded hole 70 being formed through portions 66 and 68. When it is desired to lock the core stop in position on the support means, a threaded screw 71 is threaded downwardly through hole 70 to engage bottom wall 54 of the support means and force the core stop upwardly into the locked position as shown in FIGS. 5 and 6.

As seen in FIG. 6, track means 50 includes a bottom wall 72 which joins with a lower pair of side walls 74 and 76 which in turn join with a pair of inwardly extending walls 78 and 80, which further join with a pair of upper side walls 82 and 84. The portions of the bottom wall 54 of the support means which extend laterally outwardly of the side walls 56 and 58 of the support means engage the upper surface of bottom wall 72 of the track means and the undersurfaces of the walls 78 and 80 of the track means, while the outer surfaces of walls 56 and 58 of the support means engage the inner surfaces of walls 82 and 84 of the track means. The outer surfaces of walls 74 and 76 engage the lower side walls 90 and 92 of slot 30, while the outer surfaces of walls 82 and 84 engage the upper side walls 94 and 96 of slot 30. While slight clearances have been illustrated between various interengaging surfaces, it will be understood that these various surfaces have a slidable fit with one another which permits relative longitudinal movement of the track means with respect to the shaft and which further permits relative longitudinal movement of the support means with respect to the track means, while securely retaining the track means and the support means in position when the shaft is in use.

A pair of conventional wave springs 100 and 102 are provided on opposite sides of the track means. Alternatively, coil or leaf springs may be used instead of wave springs.

Spring 100 is disposed between the undersurface 104 of slot 30 and the upper surface of wall 78, while spring 102 is disposed between the undersurface 106 of slot 30 and the upper surface of wall 80. It is apparent that these springs normally bias the track means radially inwardly of the shaft, which also the carries the support means radially inwardly, so that the entire mobile means within slot 30 is thereby biased inwardly. This arrangement enables the support means to be removed from the track means and the shaft as hereinafter explained while leaving the track means and springs 100 and 102 in the position shown in FIG. 6 wherein thrusting means 30' is inflated and the wave springs 100 and 102 have been flattened.

As seen in FIGS. 1 and 2, retainer means for retaining the track means and the support means in operative mounted position on the shaft includes a retainer member 110 which is disposed within a suitable recess formed in the shaft and spaced from the adjacent side face 16 of the shaft. Retainer member 110 is held in the operative position shown by a flat head screw 112 which extends through a hole formed in the member 110 and is threaded into a threaded hole formed in the shaft. Retainer member 110 has a flat side face 114 formed thereon which engages the end surfaces of both the track means and the support means.

Figure 3:
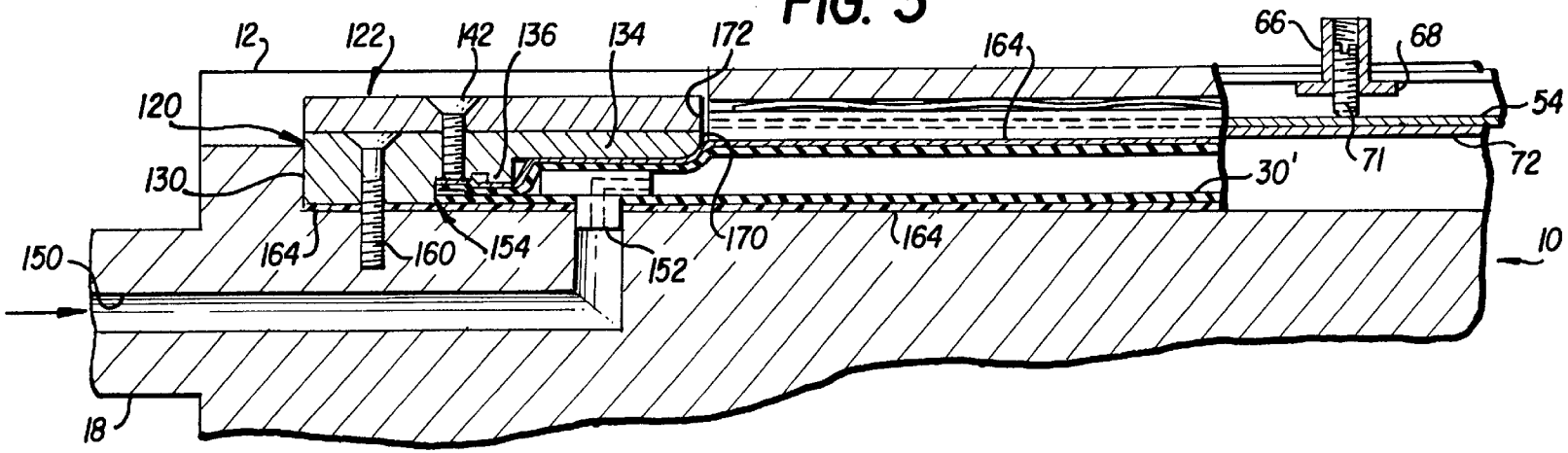
FIG. 3 is an enlarged sectional view taken along line 3—3 of FIG. 2.

As seen in FIGS. 3 and 8, the retainer means also includes a first portion 120 and a second portion 122 for engaging the opposite ends of the track means and the support means respectively. First portion 120 is received within a suitable recess formed in the shaft and includes a flat top surface 124. A through hole 126 passes through portion 120, and a separate threaded hole 128 is also formed therethrough. Portion 120 includes a thick part 130, a part 132 of reduced thickness, and a part 134 of still further reduced thickness. A depending shoulder 136 is formed between parts 132 and 134 and extends across the entire width of retainer portion 120. The second retainer portion 122 has the same plan configuration as portion 120 and has a through hole 140 formed therethrough for receiving a flat head screw 142.

Referring to FIG. 3, the shaft has the usual passage 150 formed therein for receiving air under pressure for operating the thrusting means 30', a conventional fitting 152 being mounted at the end of the passage. The remaining thrusting means also receive air under pressure in the ususal manner. Thrusting means 30' comprises a flexible tube of conventional material which has an open end 154. Retainer portion 120 is shown as fixed to the shaft by a cap screw 160; and when so fixed, the shoulder clamps the open end portion of the thrusting means together to provide an air tight seal thereat.

A protective means 164 in the form of an elongated strip of suitable material such as plastic is disposed between the bottom of slot 30 and the undersurface of part 130 of retainer portion 120 as well as the undersurface of thrusting means 30'. The strip continues around the opposite end of the thrusting means, between the top surface of the thrusting means and the undersurface of the track means, and thence between the upper surface of the thrusting means and the undersurface of retainer part 134 of retainer portion 120. Strip 164 is finally clamped in place by shoulder 136. Strip 164 prevents excessive wear on the thrusting means. The protective strip need not be positioned between the undersurface of the thrusting means and the bottom of slot 30, but may be disposed only between the top surface of the thrusting means and the undersurface of the track means. In the latter case, the opposite ends of the protective strip will be clamped in position by shoulder 136 and retainer member 110.

Retainer portion 122 is fixed to retainer portion 120 by screw 142 which extends through hole 140 of portion 122 and is threaded into threaded hole 128 of portion 120. When in the assembled position shown in FIG. 3, the end face 170 of retainer portion 120 engages the adjacent end surface of track means 50, and the end surface 172 of retainer portion 122 engages the adjacent end surface of support means 52, although slight clearances have been shown. It is evident that the retainer means retains the track means and the support means in position longitudinally of the shaft.

When it is desired to replace the support means and the core stops supported thereby, thrusting means 30' is activated, and retainer portion 122 is removed by unscrewing screw 142 as shown in FIG. 1. Support means 52 is shown as being partially removed from the track means and the shaft in this figure, the support means sliding outwardly through the opening of slot 30 at side surface 14 of the shaft. Once the support means has been completely removed, a new support means with preadjusted core stops mounted thereon can be quickly slid through the side opening of slot 30 and into the open end of the track means. Retainer portion 122 can then be placed back on retainer portion 120 and fixed in position by screw 142.

If it is desired to remove the track means from slot 30, retainer portion 120 must be removed by unscrewing screw 160, whereupon track means 50 can be slid out of slot 30 through the opening in side face 14 of the shaft. A track means can then be inserted into the slot and retained in position by fixing retainer portion 120 in operative position by means of screw 160.

Referring now to FIGS. 9–12, a modified form of the invention is illustrated wherein the shaft is of the same construction as described previously, and similar parts have been given the same reference characters.

In this modification, the support means 52' is of the same construction as support means 52 except that the length of support means 52' is less than that of 52. Whereas support means 52 has opposite ends L and L' which define a given length as seen in FIG. 2, support means 52' has opposite ends L1 and L2 which define a length less than that of support means 52. The right-hand end L2 of support means 52' contacts the face 114 of retainer member 110 in the position shown, while the left-hand end L1 of support means 52' is spaced a distance X from the face 172 of retainer portion 122.

Figure 12:
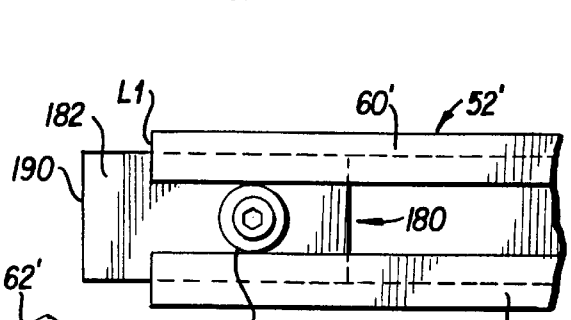
FIG. 12 is a top view showing the adjusting lug of FIG. 11 in one operative position thereof.
Figure 11:
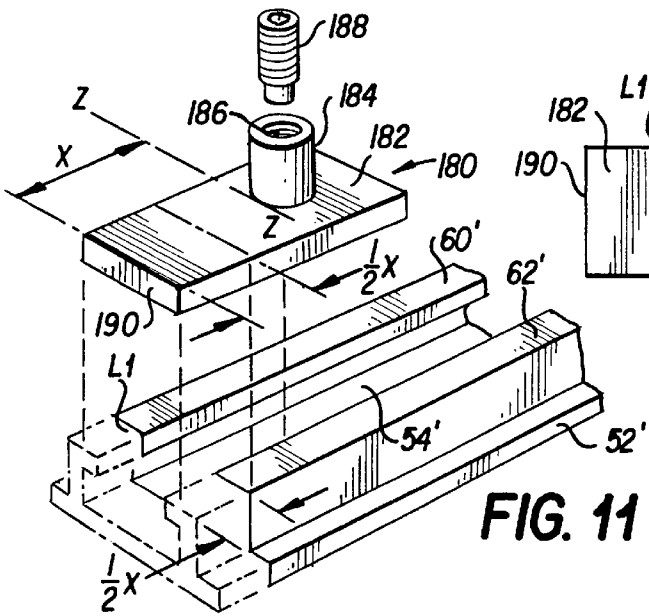
FIG. 11 is a top perspective exploded view showing one end of a support means and one adjusting lug.
Figure 10:
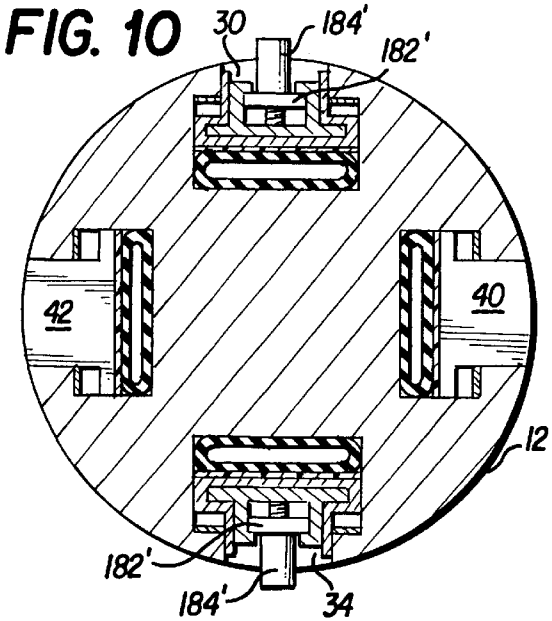
FIG. 10 is a sectional view taken along line 10—10 of FIG. 9.

A plurality of core stops 64 having cylindrical portions 66 operate in the same manner as previously described. Referring to FIGS. 11 and 12, an adjusting lug 180 is slidably mounted within end L1 of support means 52' and includes a base portion 182 and an integral threaded portion 184 sized to provide adequate thread length for the screw. A threaded hole 186 is formed through portions 182 and 184. A threaded screw 188 can be threaded downwardly through hole 186 to engage the bottom wall 54' of the support means to force adjusting lug 180 upwardly into locked position where it engages the undersurfaces of flanges 60' and 62' of support means 52'.

As seen in FIG. 11, base portion 182 of adjusting lug 180 has an end face 190, and a line Z—Z comprises a tangent which passes through a point on the outer surface of cylindrical portion 184 which is nearest to end face 190. The distance from end face 190 to line Z—Z is the same as the distance X shown in FIG. 9. Support means 52' is shown in solid lines in FIG. 11, and the broken lines indicate a portion of the support means that has been removed. This removed portion has a length of ½X as illustrated. A similar portion having a length of ½X has also been removed from the opposite end of the support means. Therefore, the support means has been reduced in length from that shown in FIG. 2 by the distance X. As shown in FIG. 12, adjusting lug 180 is locked in position with the base portion 182 extending outwardly of the support means so that face 190 thereof is in spaced a distance of ½X from end L1 of the support means.

Figure 9:
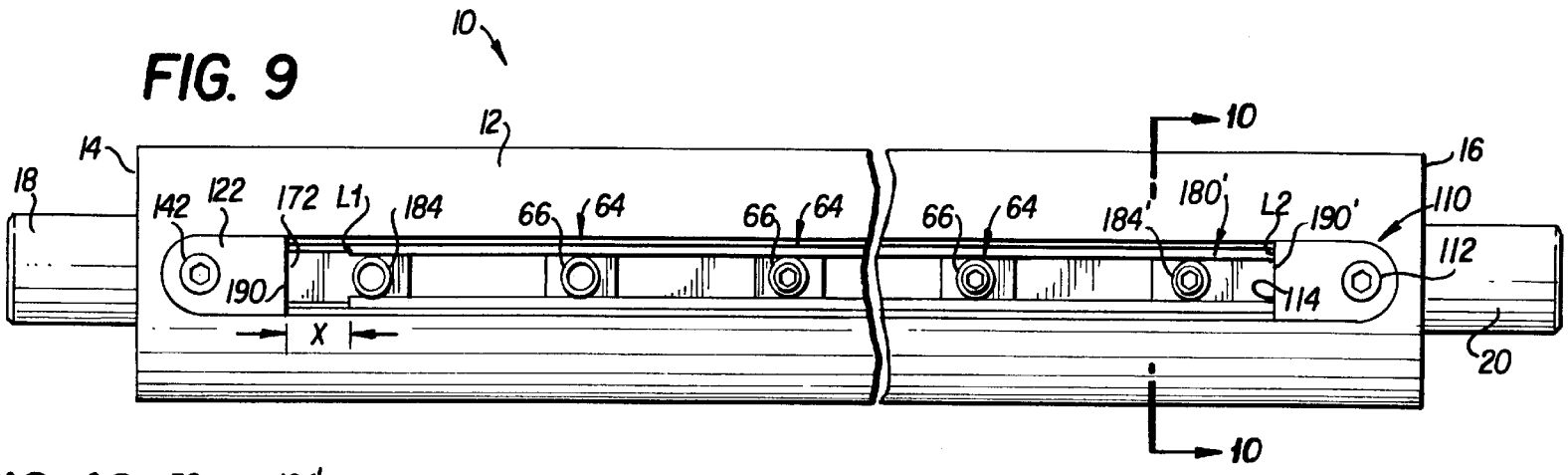
FIG. 9 is a broken away top view of a modification of the invention.

As seen in FIG. 9, another identical adjusting lug 180' is slidably supported at the opposite end L2 of the support means in a position reversed from that of adjusting lug 180. The end face 190' of lug 180' is flush with the end L2 of the support means and is in contact with the face 114 of retainer member 110. In this position of the support means, adjusting lug 180 has the end face 190 thereof in contact with the face 172 of retainer portion 122. The screws associated with adjusting lugs 180 and 180' have been screwed downwardly to lock the support means in the position shown in FIG. 9 which represents the limit of adjusting movement of the support means to the right within the associated slot of the shaft.

If it is desired to adjust the support means to the left as seen in FIG. 9, the screws of both adjusting lugs are loosened, and the support means is moved to the left to a new position, whereupon the screws are again screwed downwardly to lock the adjusting lugs in position. In any adjusted position, the end faces of the adjusting lugs 180 and 180' will be in contact with the face 172 of retainer portion 122 and face 114 of retainer member 110 respectively. Therefore, as support means 52' is adjusted to the left from the position shown in FIG. 9, end face 190 of adjusting lug 180 will move toward end L1 of the support means, and end face 190' of adjusting lug 180' will move away from end L2 of the support means.

When the support means is centered axially within the associated slot of the expanding shaft, the end faces of each of the adjusting lugs will be spaced a distance of ½X outwardly of the adjacent end of the support means.

With this construction, support means 52' can be adjusted to any position axially of the shaft between the position shown in FIG. 9 and a position wherein the support means is disposed with its end L1 in contact with face 172 of retainer portion 122. This adjustment can be carried out very efficiently by changing the positions of the adjusting lugs relative to the support means.

The invention has been described with reference to a preferred embodiment. Obviously, various modifications, alternatives and other embodiments will occur to others upon reading and understanding this specification. It is our intention to include all such modifications, alternatives and other embodiments insofar as they come within the scope of the appended claims or equivalents thereof.

What is claimed is:

1. An expanding shaft comprising, a generally cylindrical shaft having a longitudinal axis and an outer surface, said shaft having a plurality of radially disposed slots extending longitudinally of said shaft and opening at said outer surface, said shaft being adapted to support one or more tubular supports each of which has side edges and is disposed coaxially around said shaft, a plurality of mobile means each of which is disposed within one of said slots for radial movement with respect to the shaft, thrusting means for urging each of said mobile means radially outwardly of said shaft, one of said mobile means comprising track means disposed in one of said slots and support means movably supported by said track means, a plurality of core stops supported by said support means and adapted to engage the side edges of one or more tubular supports, resilient means normally biasing said one mobile means radially inwardly of said shaft, and retainer means for retaining said one mobile means in position longitudinally of said shaft.

2. An expanding shaft as defined in claim 1 wherein said resilient means comprises spring means disposed between said shaft and said track means.

3. An expanding shaft as defined in claim 2 wherein said spring means includes separate springs disposed on opposite sides of said track means.

4. An expanding shaft as defined in claim 1 wherein the track means of said one mobile means is slidably supported within the associated slot in said shaft.

5. An expanding shaft as defined in claim 4 wherein said support means is slidably supported by said track means.

6. An expanding shaft as defined in claim 5 wherein said core stops are slidably supported by said support means.

7. An expanding shaft as defined in claim 6 including locking means for locking said core stops in position longitudinally of said support means.

8. An expanding shaft as defined in claim 1 wherein said retainer means includes a first portion for retaining said track means in position relative to said shaft, and a second portion for retaining said support means in position relative to said shaft.

9. An expanding shaft as defined in claim 8 including means for fixing said first retainer portion in position longitudinally of said shaft.

10. An expanding shaft as defined in claim 9 including means for fixing said second retainer portion in position longitudinally of said first retainer portion.

11. An expanding shaft as defined in claim 8 wherein said thrusting means includes an open end portion disposed adjacent said first retainer portion, said first retainer portion including a part which clamps said end portion of the thrusting means to provide an air tight seal at said end portion.

12. An expanding shaft as defined in claim 1 including protective means disposed adjacent said thrusting means for protecting the thrusting means against excessive wear.

13. An expanding shaft as defined in claim 12 wherein said protective means includes a strip of material extending longitudinally along said thrusting means and being disposed adjacent the outer surface of said thrusting means.

14. An expanding shaft as defined in claim 1 wherein said one slot has a finite length, said support means having opposite ends and a finite length which is less than the length of said one slot, an adjusting lug being movably supported at each of said opposite ends, and means for locking said adjusting lugs in adjusted position.

15. An expanding shaft comprising, a generally cylindrical shaft having a longitudinal axis and an outer surface, said shaft having a plurality of radially disposed slots extending longitudinally of said shaft and opening at said outer surface, said shaft being adapted to support one or more tubular supports each of which has side edges and is disposed coaxially around said shaft, a plurality of mobile means each of which is disposed within one of said slots for radial movement with respect to the shaft, thrusting means for urging each of said mobile means radially outwardly of said shaft, one of said mobile means comprising elongated track means disposed within one of said slots and defining an elongated recess therein, spring means disposed between said shaft and said track means for normally biasing said track means radially inwardly of said shaft, said one mobile means also including support means slidably disposed within the recess of said track means for movement into and out of said recess, a plurality of core stops supported by said support means in predetermined spacing from one another for engaging the side edges of said tubular supports for holding the tubular supports in position longitudinally of said shaft, and retainer means for retaining said one mobile means in operative position longitudinally of said shaft.

16. An expanding shaft as defined in claim 15 wherein said core stops are adjustable longitudinally of said support means.

17. An expanding shaft as defined in claim 16 including locking means for locking said core stops in position longitudinally of said support means.

18. An expanding shaft comprising, a generally cylindrical shaft having a longitudinal axis and an outer surface, said shaft having a plurality of radially disposed slots extending longitudinally of said shaft and opening at said outer surface, said shaft being adapted to support one or more tubular supports each of which has side edges and is disposed coaxially around said shaft, a plurality of mobile means each of which is disposed within one of said slots for radial movement with respect to said longitudinal axis, thrusting means for urging each of said mobile means radially outwardly with respect to said shaft, said shaft having opposite ends and opposite side faces adjacent said opposite ends, one of said slots also opening at one of said side faces to provide a side opening at said one side face, the mobile means within said one slot comprising track means and support means slidable into and out of said one slot through said side opening, a plurality of core stops supported by said support means and adapted to engage side surfaces of one or more tubular supports, resilient means normally biasing the mobile means within said one slot radially inwardly of said shaft, and retainer means for retaining the mobile means in position within said one slot in said shaft.

19. An expanding shaft as defined in claim 18 wherein said track means has an open end, said support means being slidable into and out of said track means through said open end of the track means.

20. An expanding shaft as defined in claim 19 wherein said core stops are slidably adjustable on said support means.

21. An expanding shaft as defined in claim 20 including locking means for locking said core stops in adjusted position on said support means.

22. An expanding shaft comprising, a generally cylindrical shaft having a longitudinal axis and an outer surface, said shaft having a plurality of radially disposed slots extending longitudinally of said shaft and opening at said outer surface, said shaft being adapted to support one or more tubular supports each of which has side edges and is disposed coaxially around said shaft, a plurality of mobile means each of which is disposed within one of said slots for radial movement with respect to the shaft, thrusting means for urging each of said mobile means radially outwardly of said shaft, one of said mobile means comprising support means movably supported in one of said slots, a plurality of core stops supported by said support means and adapted to engage the side edges of one or more tubular supports, said one slot having a finite length, said support means having opposite ends and a finite length which is less than the length of said one slot, an adjusting lug being movably supported at each of said opposite ends, and means for locking said adjusting lugs in adjusted position.

23. An expanding shaft as defined in claim 22 wherein said support means is slidably supported within said one slot.

24. An expanding shaft as defined in claim 22 wherein said core stops are slidably supported by said support means.

25. An expanding shaft as defined in claim 24 including locking means for locking said core stops in position longitudinally of said support means.

* * * * *